US011974600B2

(12) United States Patent
Park et al.

(10) Patent No.: US 11,974,600 B2
(45) Date of Patent: May 7, 2024

(54) AEROSOL GENERATING DEVICE

(71) Applicant: KT&G CORPORATION, Daejeon (KR)

(72) Inventors: In Su Park, Seoul (KR); Sung Jong Ki, Daejeon (KR); Young Joong Kim, Daejeon (KR); John Tae Lee, Daejeon (KR); Sun Hwan Jung, Daejeon (KR); Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 611 days.

(21) Appl. No.: 17/283,807

(22) PCT Filed: Dec. 16, 2020

(86) PCT No.: PCT/KR2020/018439
§ 371 (c)(1),
(2) Date: Apr. 8, 2021

(87) PCT Pub. No.: WO2021/172722
PCT Pub. Date: Sep. 2, 2021

(65) Prior Publication Data

US 2022/0400749 A1 Dec. 22, 2022

(30) Foreign Application Priority Data

Feb. 24, 2020 (KR) ..... 10-2020-0022411

(51) Int. Cl.
*A24F 40/30* (2020.01)
*A24F 40/10* (2020.01)
*A24F 40/50* (2020.01)

(52) U.S. Cl.
CPC ..... *A24F 40/30* (2020.01); *A24F 40/10* (2020.01); *A24F 40/50* (2020.01)

(58) Field of Classification Search
None
See application file for complete search history.

(56) References Cited

U.S. PATENT DOCUMENTS 9,936,737 B2 4/2018 Cameron et al.
10,455,863 B2 * 10/2019 Rostami ..... A61M 15/0003
(Continued)

FOREIGN PATENT DOCUMENTS

KR 10-2014-0127288 A 11/2014
KR 10-2015-0129683 A 11/2015
(Continued)

OTHER PUBLICATIONS

Communication dated Jul. 12, 2022 from the Japanese Patent Office in Application No. 2021-527912.
(Continued)

*Primary Examiner* — Tho D Ta
(74) *Attorney, Agent, or Firm* — Sughrue Mion, PLLC

(57) ABSTRACT

An aerosol generating device includes a first vaporizer configured to generate a first aerosol by heating a first liquid composition, a second vaporizer configured to generate a second aerosol by heating a second liquid composition, and a controller controlling power supplied to the first vaporizer and the second vaporizer, based on a first mode, in which a smokeless aerosol is generated, and a second mode, in which a transport amount of nicotine included in the second liquid composition is adjusted.

15 Claims, 6 Drawing Sheets

(56) References Cited

U.S. PATENT DOCUMENTS

| | | | | |
|---|---|---|---|---|
| 10,477,900 | B2 | 11/2019 | Hopps | |
| 10,499,688 | B2 | 12/2019 | Dickens | |
| 10,716,903 | B2 | 7/2020 | Tucker et al. | |
| 10,881,141 | B2 | 1/2021 | Fraser et al. | |
| 10,881,143 | B2 | 1/2021 | Suzuki et al. | |
| 10,881,148 | B2 | 1/2021 | Nakano et al. | |
| 11,033,055 | B2 | 6/2021 | Fraser et al. | |
| 2014/0360517 | A1* | 12/2014 | Taggart | A24F 40/485 131/329 |
| 2016/0022930 | A1 | 1/2016 | Greim et al. | |
| 2016/0309784 | A1 | 10/2016 | Silvestrini et al. | |
| 2019/0380381 | A1 | 12/2019 | Hassan et al. | |
| 2020/0154773 | A1 | 5/2020 | Lim et al. | |
| 2020/0229501 | A1 | 7/2020 | Han et al. | |
| 2020/0305512 | A1 | 10/2020 | Lim et al. | |
| 2021/0227892 | A1 | 7/2021 | Leah et al. | |
| 2023/0077221 | A1* | 3/2023 | Park | A24F 40/10 |

FOREIGN PATENT DOCUMENTS

| | | | |
|---|---|---|---|
| KR | 10-2016-0098212 | A | 8/2016 |
| KR | 10-2016-0112769 | A | 9/2016 |
| KR | 10-2018-0012830 | A | 2/2018 |
| KR | 10-2018-0014090 | A | 2/2018 |
| KR | 10-2018-0070440 | A | 6/2018 |
| KR | 10-2018-0124739 | A | 11/2018 |
| KR | 10-2018-0129995 | A | 12/2018 |
| KR | 10-1930663 | B1 | 12/2018 |
| KR | 10-2019-0049392 | A | 5/2019 |
| WO | 2016/178377 | A1 | 11/2016 |
| WO | 2017/141358 | A1 | 8/2017 |
| WO | 2017/185051 | A1 | 10/2017 |
| WO | 2018/146455 | A1 | 8/2018 |
| WO | 2018/185460 | A1 | 10/2018 |
| WO | 2019/215213 | A1 | 11/2019 |

OTHER PUBLICATIONS

International Search Report for PCT/KR2020/018439 dated Mar. 26, 2021 (PCT/ISA/210).

Communication dated Nov. 19, 2021 from the Korean Intellectual Property Office in Application No. 10-2020-0022411.

Extended European Search Report dated Nov. 22, 2021 in Application No. 20875661.9.

* cited by examiner

AEROSOL GENERATING DEVICE

CROSS REFERENCE TO RELATED APPLICATIONS

This application is a National Stage of International Application No. PCT/KR2020/018439 filed Dec. 16, 2020, claiming priority based on Korean Patent Application No. 10-2020-0022411 filed Feb. 24, 2020.

TECHNICAL FIELD

The present disclosure relates to an aerosol generating device, and more particularly, to an aerosol generating device capable of generating a smokeless aerosol or a smoke aerosol by controlling power supplied to vaporizers.

BACKGROUND ART

Recently, the demand for alternative methods to overcome the shortcomings of general cigarettes has increased. For example, there is an increasing demand for a method of generating aerosol by heating an aerosol generating material in cigarettes or liquid storages rather than by burning cigarettes.

However, when using a prior art aerosol generating device, it is impossible to convert a mode, in which a smokeless aerosol is generated, into a mode, in which a smoke aerosol is generated, and adjust the transport amount of flavors, nicotine, or the like, depending on the user preference.

DESCRIPTION OF EMBODIMENTS

Technical Problem

Technical problems to be solved by the present disclosure are to provide an aerosol generating device for adjusting an aerosol generation amount and an aerosol generating system.

The technical problems of the present disclosure are not limited to the above-described description, and other technical problems may be derived from the embodiments to be described hereinafter.

Solution to Problem

According to an aspect of the present disclosure, an aerosol generating device includes a first vaporizer configured to generate a first aerosol by heating a first liquid composition, a second vaporizer configured to generate a second aerosol by heating a second liquid composition, and a controller controlling power supplied to the first vaporizer and the second vaporizer, based on a first mode, in which a smokeless aerosol is generated, and a second mode in which the transport amount of nicotine included in the second liquid composition is adjusted.

Advantageous Effects of Disclosure

According to necessity, in an aerosol generating system and an aerosol generating device, a smokeless mode in which a smokeless aerosol is generated may be converted to a smoke mode in which a smoke aerosol is generated.

Also, in the aerosol generating system and the aerosol generating device, the transport amount of flavors, nicotine, or the like may be adjusted according to the user preference.

Effects of the present disclosure are not limited to the descriptions above, and various effects are stated in the present specification.

BEST MODE

Figure 1:
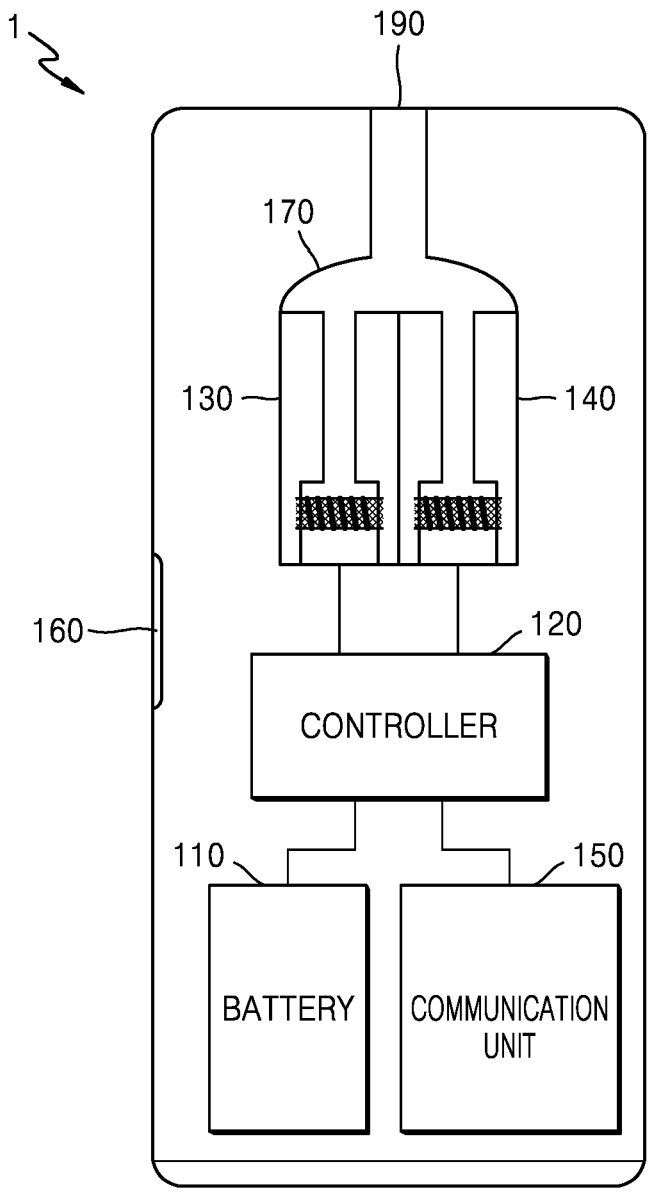
FIG. 1 illustrates an aerosol generating device.

According to an aspect of the present disclosure, an aerosol generating device includes a first vaporizer configured to generate a first aerosol by heating a first liquid composition, a second vaporizer configured to generate a second aerosol by heating a second liquid composition, and a controller controlling power supplied to the first vaporizer and the second vaporizer, based on a first mode, in which a smokeless aerosol is generated, and a second mode, in which a transport amount of nicotine included in the second liquid composition is adjusted.

The first liquid composition may include a first moisturizer and nicotine.

the first moisturizer may only include vegetable glycerin.

The first moisturizer may include a mixture in which vegetable glycerin and propylene glycol are mixed at a certain ratio.

A ratio of the vegetable glycerin to the propylene glycol in the first moisturizer may be between 4:1 and 9:1.

The aerosol generating device may further include a communication unit configured to communicate with an external device.

The communication unit may be configured to receive a remote control signal from the external device, and the controller may be configured to control power supplied to the first vaporizer and the second vaporizer, based on the remote control signal.

The remote control signal may include mode selection information regarding the first and second modes and power control information corresponding to a selected mode.

The controller may be configured to supply power only to the second vaporizer in the first mode.

The first mode may include a plurality of sub-modes, and the controller may be configured to supply power to the second vaporizer to enable an output of the second vaporizer to be in a range from about 50% to about 100% of a maximum output of the second vaporizer, corresponding to the plurality of sub-modes.

The controller may be configured to, in the second mode, selectively supply power to the second vaporizer while power is supplied to the first vaporizer.

The second mode may include a plurality of sub-modes, and the controller may be configured to supply power to the first vaporizer to enable the output of the first vaporizer to be in a range from about 80% to about 100% of the maximum output of the first vaporizer and power to the second vaporizer to enable the output of the second vaporizer to be in a range from about 0% to about 70% of the maximum output of the second vaporizer, corresponding to the plurality of sub-modes.

The aerosol generating device may further include a chamber in which the first aerosol and the second aerosol are mixed.

At least a portion of the chamber may be formed as the first vaporizer is coupled to the second vaporizer.

The first vaporizer and the second vaporizer may be integrally formed, and at least a portion of the chamber may be formed by the first vaporizer and the second vaporizer that are integrally formed.

MODE OF DISCLOSURE

With respect to the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. An aerosol generating device and an aerosol generating system may be embodied in many different forms and should not be construed as being limited to the embodiments set forth herein.

In embodiments below, outputs of vaporizers may have the same meaning as power consumed by the vaporizers.

Sizes of components in the drawings may be exaggerated for convenience of explanation. In other words, since sizes and thicknesses of components in the drawings are arbitrarily illustrated for convenience of explanation, the following embodiments are not limited thereto.

Hereinafter, one or more embodiments will be described in detail with reference to the attached drawings.

FIG. 1 illustrates an aerosol generating device.

Referring to the drawing, an aerosol generating device 1 may include a battery 110, a controller 120, a first vaporizer 130, a second vaporizer 140, a communication unit 150, and an input unit 160. Also, the aerosol generating device 1 may further include a chamber 170 in which a first aerosol and a second aerosol are mixed.

FIG. 1 illustrates components related to the present embodiment. Therefore, one of ordinary skill in the art could understand that other general-purpose components, other than the components of FIG. 1, may be further included in the aerosol generating device 1.

Also, the arrangements of the battery 110, the controller 120, the first vaporizer 130, the second vaporizer 140, the communication unit 150, and the input unit 160 are merely examples, and an internal structure of the aerosol generating device 1 is not limited to the illustration of FIG. 1. In other words, according to a design of the aerosol generating device 1, the arrangements of the battery 110, the controller 120, the first vaporizer 130, the second vaporizer 140, the communication unit 150, and the input unit 160 may be changed.

When a user input or pressure in the aerosol generating device 1 varies, the aerosol generating device 1 may drive at least one of the first vaporizer 130 and the second vaporizer 140 to generate an aerosol. The aerosol generated by the first vaporizer 130 and/or the second vaporizer 140 may be provided to a user by passing through the chamber 170.

The battery 110 may supply power used to operate the aerosol generating device 1. For example, the battery 110 may supply power to heat the first vaporizer 130 and the second vaporizer 140 and power necessary to drive the controller 120. Also, the battery 110 may supply power necessary to drive a display, a sensor, a motor, and the like installed in the aerosol generating device 1.

The controller 120 may control all operations of the aerosol generating device 1. In detail, the controller 120 may control operations of the battery 110, the first vaporizer 130, the second vaporizer 140, and other components included in the aerosol generating device 1. Also, the controller 120 may identify a state of each component of the aerosol generating device 1 and determine whether the aerosol generating device 1 is operable.

The controller 120 may include at least one processor. A processor can be implemented as an array of a plurality of logic gates or as a combination of a general-purpose microprocessor and a memory in which a program executable by the microprocessor is stored. Also, it will be understood by one of ordinary skill in the art that the processor can be implemented in other forms of hardware.

The first vaporizer 130 and the second vaporizer 140 may generate aerosols by heating liquid compositions therein, and the generated aerosols may pass through the chamber 170 to be delivered to the user.

In detail, the first vaporizer 130 and the second vaporizer 140 may be accommodated in the aerosol generating device 1 while containing the liquid compositions. When the liquid compositions are completely consumed, the first vaporizer 130 and the second vaporizer 140 may be replaced with new vaporizers. According to an embodiment, liquid storages 131 and 141 (of FIG. 2) storing the liquid compositions may only be replaced.

The liquid compositions may include aerosol generating materials for generating aerosols. The first vaporizer 130 and the second vaporizer 140 may respectively change phases of the aerosol generating materials inside the first vaporizer 130 and the second vaporizer 140 to gaseous phases. The aerosol may refer to a gas in which vaporized particles generated from an aerosol generating material are mixed with air.

For example, the first vaporizer 130 and the second vaporizer 140 may respectively convert the phases of the aerosol generating materials by receiving electrical signals from the controller 120 and heating the aerosol generating materials, or by using an induction heating method.

The first vaporizer 130 and the second vaporizer 140 may include heating elements for heating the aerosol generating materials.

The first vaporizer 130 may include a first liquid composition for generating a smoke aerosol. The second vaporizer 140 may include a second liquid composition for generating a smokeless aerosol.

The first vaporizer 130 may generate the first aerosol by heating the first liquid composition. The second vaporizer 140 may generate the second aerosol by heating the second liquid composition. The first aerosol and the second aerosol may be mixed in the chamber 170. Also, a mixture of the first aerosol and the second aerosol may be discharged to the outside through an outlet 190.

The controller 120 may control the power supplied to the first vaporizer 130 and the second vaporizer 140 and thus may adjust the generation, the generated amount, and the like of the smoke aerosol and/or the smokeless aerosol.

The controller 120 may control the power supplied to the first vaporizer 130 and the second vaporizer 140 according to a first mode, in which a smokeless aerosol is generated, and a second mode, in which the transport amount of nicotine included in an aerosol generating product is adjusted.

The controller 120 may supply power only to the second vaporizer 140 in the first mode. The first mode may include sub-modes. The controller 120 may supply the power to the second vaporizer 140 to enable a maximum output of the second vaporizer 140 to range from about 50% to about 100%, according to the sub-modes.

The sub-modes may include a first sub-mode, in which a smokeless aerosol is generated with minimum power, and a second sub-mode, in which the transport amount of nicotine included in the second liquid composition is maximized. According to an embodiment, the number of sub-modes may increase.

A temperature of a second heater 145 (of FIG. 2) has to be higher than a vaporization temperature of the second liquid composition to allow the second vaporizer 140 to generate the smokeless aerosol. Therefore, the minimum power may be set according to the vaporization temperature of the second liquid composition. In an embodiment, the minimum power may denote power consumed by a heating element of the second vaporizer 140 when the heating element of the second vaporizer 140 has the vaporization temperature of the second liquid composition. For example, the minimum power may be identical to power consumed by the second vaporizer 140 when the second vaporizer 140 operates at 50% of the maximum output. In other words, the controller 120 may supply power to the second vaporizer 140 to allow the second vaporizer 140 to operate at 50% of the maximum power in the first sub-mode.

Because the transport amount of nicotine included in the second liquid composition is proportional to the output of the second vaporizer 140, the second vaporizer 140 has to operate at the maximum output (100%) to maximize the transport amount of nicotine included in the second liquid composition. Therefore, the controller 120 may supply the power to the second vaporizer 140 to allow the second vaporizer 140 to operate at the maximum power (100%) in the second sub-mode.

In the second mode, the controller 120 may selectively supply the power to the second vaporizer 140 while the power is supplied to the first vaporizer 130. The second mode may include sub-modes. The controller 120 may supply power to the first vaporizer 130 to enable an output of the first vaporizer 130 to be in a range from about 80% to about 100% of the maximum power, and power to the second vaporizer 140 to enable an output of the second vaporizer 140 to be in a range from about 0% to about 70% of the maximum power, corresponding to the sub-modes.

The sub-modes may include a third sub-mode, in which the amount of smoke is maximized and the transport amount of nicotine is minimized, and a fourth sub-mode that is a normal mode. According to an embodiment, the number of sub-modes may increase.

The amount of smoke may increase proportionally to a temperature of a first heater 135 (of FIG. 2) included in the first vaporizer 130, and thus, the first vaporizer 130 has to operate at the maximum output (100%) to maximize the amount of smoke. On the contrary, the second vaporizer 140 has to operate at a minimum output to minimize the transport amount of nicotine. Therefore, in the third sub-mode, the controller 120 may supply the power to the first vaporizer 130 to make the first vaporizer 130 operate at the maximum output (100%) and may not supply power to the second vaporizer 140. Unlike in the second sub-mode, the reason why the power is not supplied to the second vaporizer 140 in the third sub-mode is the first aerosol is generated by the first vaporizer 130.

The fourth sub-mode may correspond to the normal mode. The fourth sub-mode may be a mode for an appropriate amount of transported nicotine and an appropriate amount of smoke. In the fourth sub-mode, the controller 120 may supply power to the first vaporizer 130 to make the first vaporizer 130 operate at 80% of the maximum output, and supply power to the second vaporizer 140 to make the second vaporizer 140 operate at 70% of the maximum output.

The input unit 160 may receive a user input. For example, the input unit 160 may be a pressure-type push button.

When receiving an operation command of the aerosol generating device 1, the input unit 160 may transmit a control signal corresponding to the operation command to the controller 120. For example, the operation command may include an on/off command, a mode change command, a power control command, a command for communication with an external device, or the like. The controller 120 may control each component inside the aerosol generating device 1, according to the control signal.

The communication unit 150 may communicate with an external device 3 (of FIG. 6) in a wired and/or wireless manner. To this end, the communication unit 150 may include one or more communication modules. For example, the communication unit 150 may include a Wi-Fi communication module, an NFC communication module, a Zigbee communication module, a Bluetooth communication module, or the like.

The external device 3 may include a desktop computer and a fixed terminal equivalent thereto, or a portable device such as a laptop, a tablet computer, or a mobile phone.

The aerosol generating device 1 may further include general-purpose components in addition to the battery 110, the controller 120, the first vaporizer 130, the second vaporizer 140, the communication unit 150, and the input unit 160. For example, the aerosol generating device 1 may include a display capable of outputting visual information and/or a motor for outputting tactile information. Also, the aerosol generating device 1 may include at least one sensor (a puff detection sensor, a temperature detection sensor, or the like).

Figure 2:
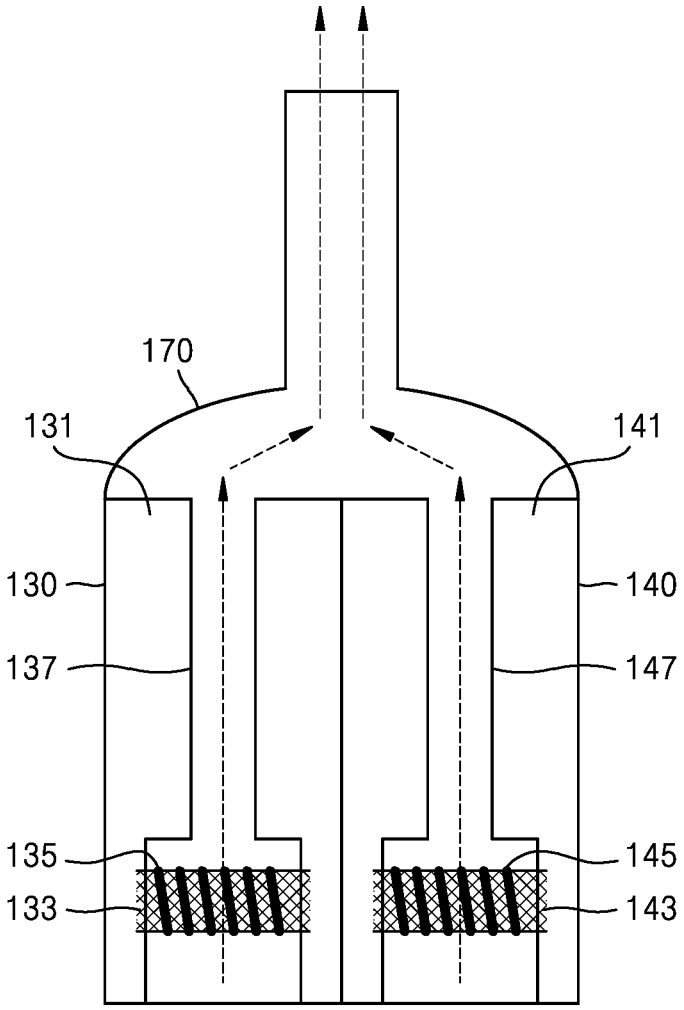
FIG. 2 illustrates a first vaporizer, a second vaporizer, and a chamber, according to an embodiment.

FIG. 2 illustrates a first vaporizer, a second vaporizer, and a chamber, according to an embodiment.

Referring to FIG. 2, the first vaporizer 130 and the second vaporizer 140 may respectively generate the first aerosol and the second aerosol by heating the liquid compositions, and the first aerosol and the second aerosol may be mixed in the chamber 170 to be delivered to the user. In this case, the first vaporizer 130 may generate smoke to make the user feel the same way as smoking a combustive cigarette, and the second vaporizer 140 adjusts the transport amount of nicotine included in the second liquid composition.

In detail, the first vaporizer 130 may include a first liquid storage 131, a first liquid delivery element 133, and the first heater 135. The second vaporizer 140 may include a second liquid storage 141, a second liquid delivery element 143, and the second heater 145.

The first liquid storage 131 may store the first liquid composition. The first liquid composition may be a liquid including a tobacco-containing material having a volatile tobacco flavor component, or a liquid including a non-tobacco material. When heated, the first liquid composition may generate smoke. In other words, the first liquid composition may be a tobacco-containing material or a non-tobacco material capable of generating smoke, and the first aerosol generated when the first liquid composition is heated may be a smoke aerosol.

The first liquid composition may include a first moisturizer. In an embodiment, the first moisturizer may include Vegetable Glycerin (VG). In another embodiment, the first moisturizer may include VG and propylene glycol to improve a physical property (flow) of the first liquid composition. In this case, a ratio of VG to propylene glycol may be between about 4:1 and about 9:1.

The first liquid composition may further include water, a solvent, ethanol, plant extract, spices, flavorings, or a vitamin mixture, in addition to the first moisturizer. Also, the first liquid composition may further include nicotine.

The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto.

The second liquid storage 141 may store the second liquid composition. The second liquid composition may be a liquid including a tobacco-containing material having a volatile tobacco flavor component, or a liquid including a non-tobacco material. Even when heated, the second liquid composition may not generate smoke. In other words, the second liquid composition may be a tobacco-containing material or a non-tobacco material that does not generate smoke, and the second aerosol generated when the second liquid composition is heated may be a smokeless aerosol.

The second liquid composition may include a second moisturizer. In an embodiment, the second moisturizer may only include propylene glycol. In another embodiment, the second moisturizer may further include ethylene glycol, dipropylene glycol, diethylene glycol, triethylene glycol, tetraethylene glycol, oleyl alcohol, and the like.

Also, the second liquid composition may further include water, a solvent, ethanol, plant extract, spices, flavorings, or a vitamin mixture, in addition to the second moisturizer. Also, the second liquid composition may further include nicotine.

The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto.

The first liquid delivery element 133 may deliver the first liquid composition to the first heater 135. The second liquid delivery element 143 may deliver the second liquid composition to the second heater 145. For example, the first liquid delivery element 133 and the second liquid delivery element 143 may each be a wick such as cotton fiber, ceramic fiber, glass fiber, or porous ceramic, but are not limited thereto.

The first heater 135 may heat the first liquid composition delivered by the first liquid delivery element 133. The second heater 145 may heat the second liquid composition delivered by the second liquid delivery element 143. For example, the first heater 135 and the second heater 145 may each be a metal heating wire, a metal hot plate, a ceramic heater, or the like, but are not limited thereto. Also, the first heater 135 and the second heater 145 may each include a conductive filament such as nichrome wire and may be wound around the liquid delivery elements 133 and 143. The first heater 135 and the second heater 145 may be heated by a current supply and may transfer heat to the liquid composition in contact with the first heater 135 and the second heater 145, thereby heating the liquid compositions. As a result, the first aerosol and/or the second aerosol may be generated.

The first heater 135 may generate the first aerosol by heating the first liquid composition. The first aerosol may be delivered to the chamber 170 through a first path 137. The second heater 145 may generate the second aerosol by heating the second liquid composition. The second aerosol may be delivered to the chamber 170 through a second path 147. The first aerosol and the second aerosol may be mixed in the chamber 170 to be delivered to the user.

The first vaporizer 130 and the second vaporizer 140 may each be referred to as a cartomizer or an atomizer, but are not limited thereto.

Figure 3:
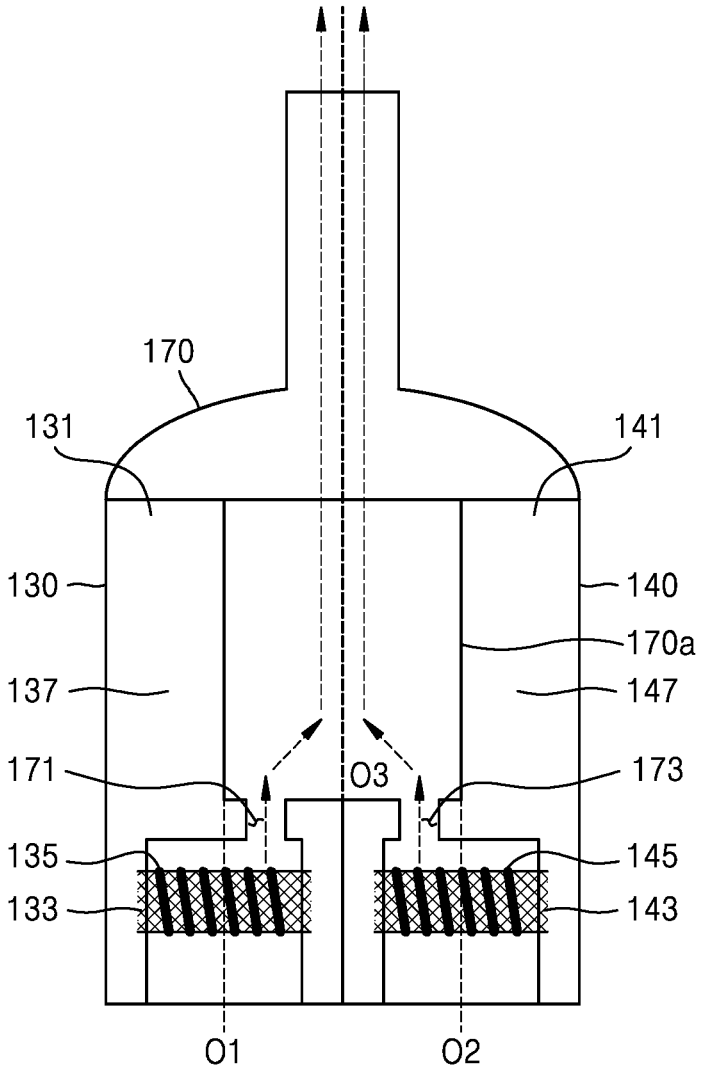
FIG. 3 illustrates a first vaporizer, a second vaporizer, and a chamber, according to another embodiment.

FIG. 3 illustrates a first vaporizer, a second vaporizer, and a chamber, according to another embodiment.

A difference between FIGS. 2 and 3 lies in a formation method of the chamber 170. FIG. 2 illustrates that the chamber 170 is separately provided, whereas FIG. 3 illustrates that the first vaporizer 130 and the second vaporizer 140 form part of the chamber 170. Hereinafter, the descriptions provided with reference to FIG. 2 will not be repeated.

Referring to the drawing, the first vaporizer 130 and the second vaporizer 140 may be detachably coupled to each other or may be integrally formed. A portion 170*a* of the chamber 170 may be formed by the first vaporizer 130 and the second vaporizer 140.

The first vaporizer 130 may include a first through hole 171 in fluid connection with the portion 170*a* of the chamber 170, and the second vaporizer 140 may include a second through hole 173 in fluid connection with the portion 170*a* of the chamber 170. The first through hole 171 is positioned between a vertical centerline 01 of the first heater 135 and a vertical centerline 03 of the chamber 170, and the second through hole 173 is positioned between a vertical centerline 02 of the second heater 145 and the vertical centerline 03 of the chamber 170 such that the first vaporizer 130 and the second vaporizer 140 form part of the chamber 170. In this case, a vertical direction may be identical to a lengthwise direction of the aerosol generating device 1.

As illustrated in FIGS. 2 and 3, a capacity of the chamber 170, of which the portion 170*a* is formed by the first vaporizer 130 and the second vaporizer 140, is greater than a capacity of the chamber 170 formed separately from the first vaporizer 130 and the second vaporizer 140. Accordingly, the first aerosol and the second aerosol may be uniformly mixed.

Figure 4:
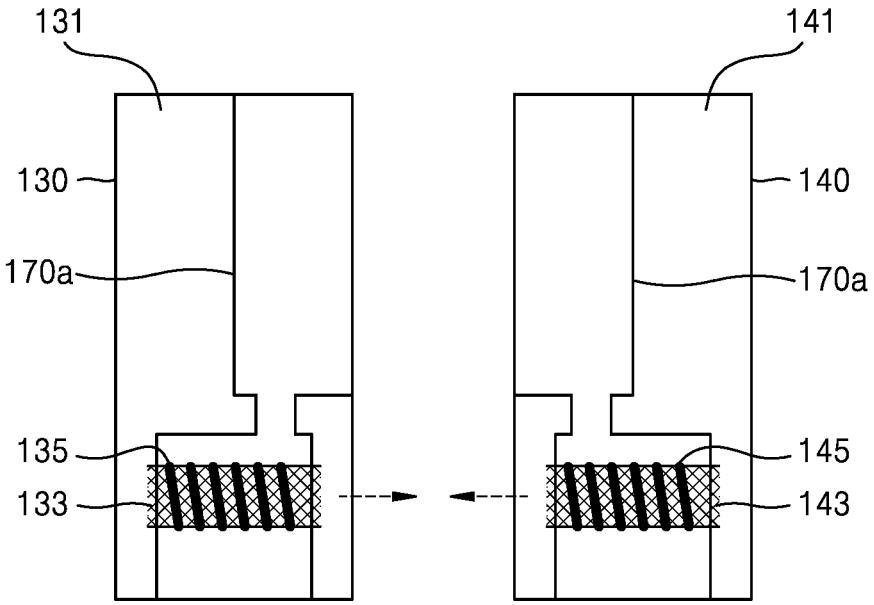
FIG. 4 is a diagram for explaining a method of coupling a first vaporizer to a second vaporizer and a chamber forming method, according to an embodiment.

FIG. 4 is a diagram for explaining a method of coupling a first vaporizer to a second vaporizer and a chamber forming method, according to an embodiment.

Referring to the drawing, the first vaporizer 130 and the second vaporizer 140 may be detachably combined.

For example, any one of the first vaporizer 130 and the second vaporizer 140 may include a hook, and the other thereof may include a locking hook. Thus, the first vaporizer 130 and the second vaporizer 140 may be coupled to each other.

As another example, any one of the first vaporizer 130 and the second vaporizer 140 may include a protrusion, and the other thereof may include a groove corresponding to the protrusion. Thus, the first vaporizer 130 and the second vaporizer 140 may be coupled to each other in a fitting manner.

However, a method of coupling the first vaporizer 130 to the second vaporizer 140 is not limited thereto. When the first vaporizer 130 and the second vaporizer 140 are detachably coupled to each other, the coupling method is not limited to the above method.

Because of the coupling of the first vaporizer 130 and the second vaporizer 140 to each other, the portion 170*a* of the chamber 170, in which the first aerosol and the second aerosol are mixed, may be generated.

The aerosol generating device 1 may operate in the first mode, in which the smokeless aerosol is generated, or the second mode, in which the transport amount of nicotine is adjusted, and thus, consumption degrees of the first liquid composition and the second liquid composition may differ according to a use pattern of the user. The aerosol generating device 1 according to an embodiment has the advantage that a consumed vaporizer is only replaced.

Figure 5:
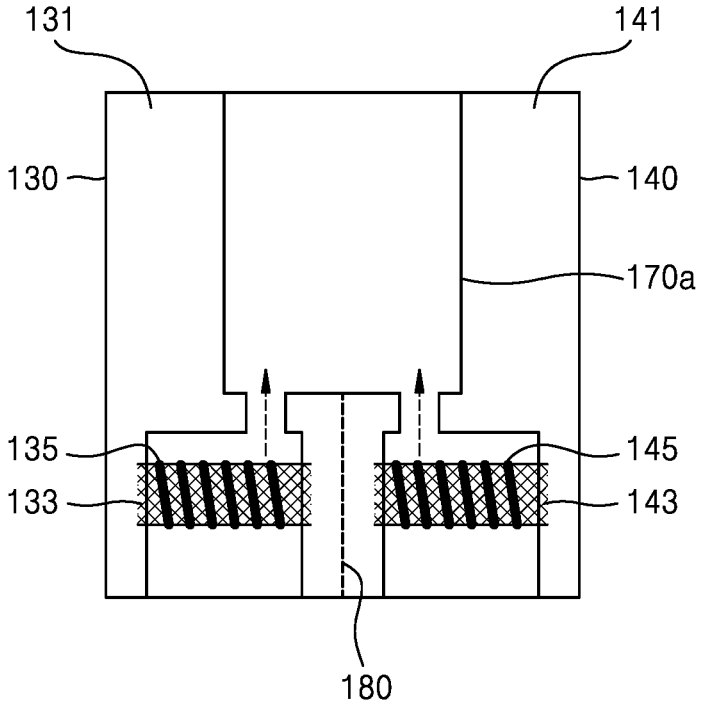
FIG. 5 is a diagram for explaining a method of coupling a first vaporizer to a second vaporizer and a chamber forming method, according to another embodiment.

FIG. 5 is a diagram for explaining a method of coupling a first vaporizer to a second vaporizer and a chamber forming method, according to another embodiment.

Referring to the drawing, the first vaporizer 130 and the second vaporizer 140 according to another embodiment may be integrally formed. In this case, the first liquid storage 131 and the second liquid storage 142 may be divided by a partition 180.

The portion 170*a* of the chamber 170, in which the first aerosol and the second aerosol are mixed, may be formed by the first vaporizer 130 and the second vaporizer 140 that are integrally formed.

When the first vaporizer 130 and the second vaporizer 140 are integrally formed, the ease of manufacture may increase.

Figure 6:
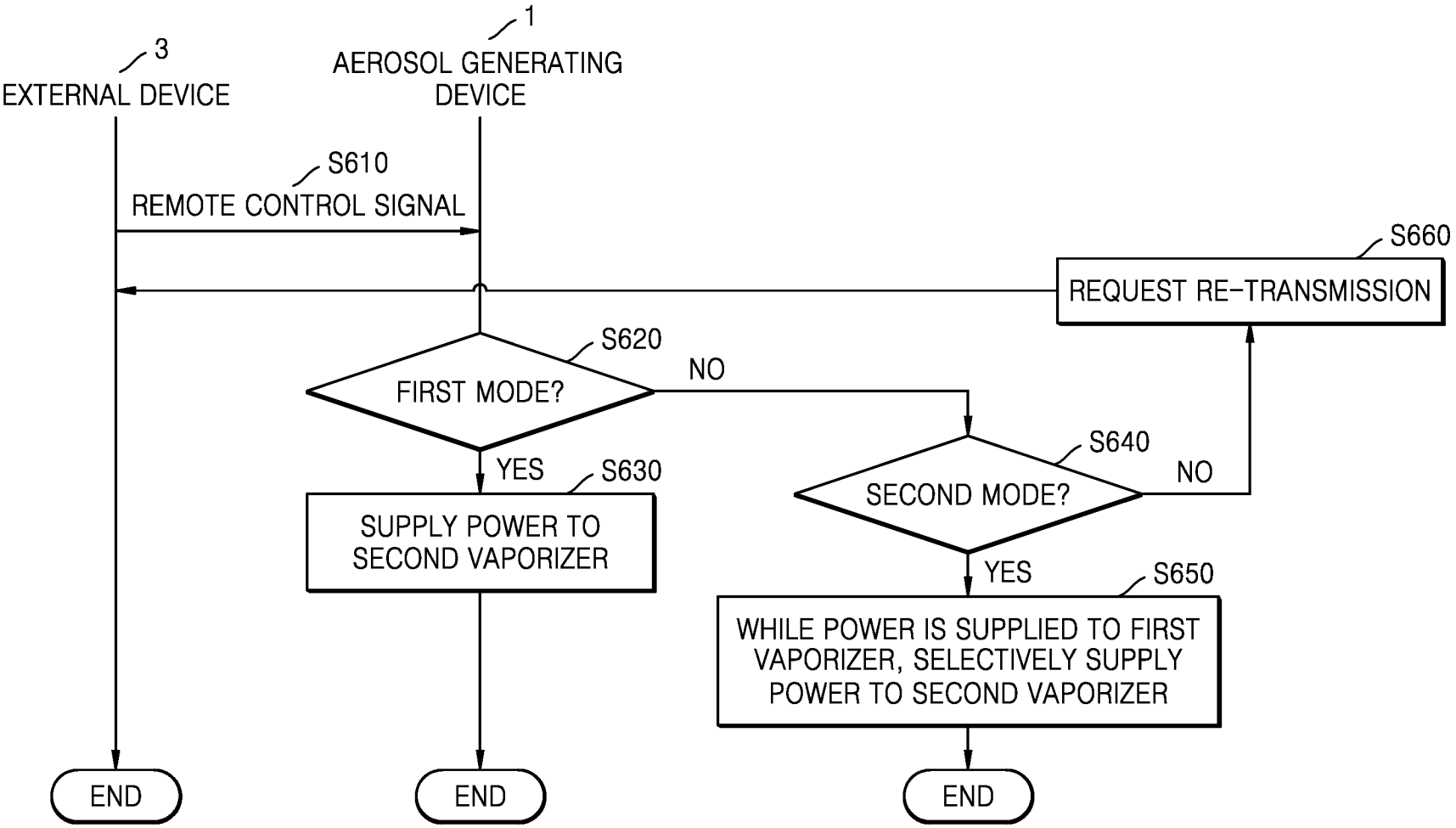
FIG. 6 is a flowchart of an operation method of an aerosol generating device.

FIG. 6 is a flowchart of an operation method of an aerosol generating device according to an embodiment.

Referring to the drawing, in operation S610, the external device 3 may transmit a remote control signal to the aerosol generating device 1 in a wireless or wired manner. The remote control signal may include mode selection information and power control information.

The communication unit 150 included in the aerosol generating device 1 may receive the remote control signal. To this end, the communication unit 150 may include one or more communication modules. For example, the communication unit 150 may include a Wi-Fi communication module, an NFC communication module, a Zigbee communication module, a Bluetooth communication module, or the like.

In operation S620, the controller 120 may analyze an operation mode according to the remote control signal received by the communication unit 150. The controller 120 may analyze the operation mode based on the mode selection information.

The operation mode may include the first mode, in which a smokeless aerosol is generated, and a second mode, in which the transport amount of nicotine included in the second liquid composition is adjusted.

In operation S630, the controller 120 may provide power only to the second vaporizer 140 when the operation mode included in the mode selection information is the first mode. In other words, when the operation mode is the first mode, the controller 120 may not provide power to the first vaporizer 130.

The second vaporizer 140 may include the second liquid composition used to generate the smokeless aerosol. In an embodiment, the second liquid composition may include the second moisturizer, and the second moisturizer may include propylene glycol.

Because of the power supply to the second vaporizer 140, the second aerosol that is smokeless may be generated. The second aerosol may include nicotine. The second aerosol may be delivered to the user by passing through the chamber 170.

The first mode may include sub-modes. The controller 120 may supply power to the second vaporizer 140 to enable an output of the second vaporizer 140 to be in a range from about 50% to about 100% of the maximum output, corresponding to the sub-modes.

In operation S640, when the operation mode included in the mode selection information is not the first mode, the controller 120 may analyze whether the operation mode is the second mode.

In operation S650, when the operation mode is the second mode, the controller 120 may selectively supply power to the second vaporizer 140 while supplying power to the first vaporizer 130.

The first vaporizer 130 may include the first liquid composition used to generate the smoke aerosol. The first liquid composition may include a first moisturizer. In an embodiment, the first moisturizer may only include VG. In another embodiment, the first moisturizer may be a mixture in which VG and propylene glycol are mixed at a certain ratio. For example, a ratio of VG to propylene glycol may be between about 4:1 and about 9:1. When the first moisturizer further includes propylene glycol, a physical property (flow) of the first liquid composition may be improved.

Because of power supply to the first vaporizer 130, the first aerosol that is a smoke aerosol may be generated. Also, when power is supplied to the second vaporizer 140, the second aerosol that is a smokeless aerosol may be generated.

The first aerosol may be delivered to the user through the chamber 170. Also, when power is supplied to the second vaporizer 140, the first aerosol and the second aerosol may be mixed in the chamber 170 and delivered to the user.

The second mode may include sub-modes. The controller 120 may supply power to the first vaporizer 130 to enable the output of the first vaporizer 130 to be in a range from about 80% to about 100% of the maximum output and power to the second vaporizer 140 to enable the output of the second vaporizer 140 to be in a range from about 0% to about 70% of the maximum output, corresponding to the sub-modes.

In operation S660, when the operation mode is neither the first mode nor the second mode, the controller 120 may determine that an error occurs and thus may send a request for re-transmission of a remote control signal.

The above-described method can be written as computer programs and can be implemented in general-use digital computers that execute the programs using a computer-readable recording medium. Also, structures of data used in the above-described method may be recorded on computer-readable recording media by using various media. Examples of the computer-readable recording medium include magnetic storage media (e.g., ROM, RAM, USB, floppy disks, hard disks, etc.), optical recording media (e.g., CD-ROMs or DVDs), etc.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol generating device comprising:

a first vaporizer configured to generate a first aerosol by heating a first liquid composition;

a second vaporizer configured to generate a second aerosol by heating a second liquid composition; and a controller controlling power supplied to the first vaporizer and the second vaporizer, based on a first mode, in which a smokeless aerosol is generated, and a second mode, in which a transport amount of nicotine included in the second liquid composition is adjusted.

2. The aerosol generating device of claim 1, wherein the first liquid composition comprises a first moisturizer and nicotine.

3. The aerosol generating device of claim 2, wherein the first moisturizer only comprises vegetable glycerin.

4. The aerosol generating device of claim 2, wherein the first moisturizer comprises a mixture in which vegetable glycerin and propylene glycol are mixed at a certain ratio.

5. The aerosol generating device of claim 4, wherein a ratio of the vegetable glycerin to the propylene glycol in the first moisturizer is between about 4:1 and about 9:1.

6. The aerosol generating device of claim 1, further comprising a communication unit configured to communicate with an external device.

7. The aerosol generating device of claim 6, wherein the communication unit is configured to receive a remote control signal from the external device, and the controller is configured to control power supplied to the first vaporizer and the second vaporizer, based on the remote control signal.

8. The aerosol generating device of claim 7, wherein the remote control signal comprises mode selection information regarding the first and second modes and power control information corresponding to a selected mode.

9. The aerosol generating device of claim 1, wherein the controller is configured to supply power only to the second vaporizer in the first mode.

10. The aerosol generating device of claim 9, wherein the first mode comprises a plurality of sub-modes, and the controller is configured to supply power to the second vaporizer to enable an output of the second vaporizer to be in a range from about 50% to about 100% of a maximum output of the second vaporizer, corresponding to the plurality of sub-modes.

11. The aerosol generating device of claim 1, wherein the controller is configured to, in the second mode, selectively supply power to the second vaporizer while power is supplied to the first vaporizer.

12. The aerosol generating device of claim 11, wherein the second mode comprises a plurality of sub-modes, and the controller is configured to supply power to the first vaporizer to enable an output of the first vaporizer to range from about 80% to about 100% of a maximum output of the first vaporizer, corresponding to the plurality of sub-modes, and supply power to the second vaporizer to enable an output of the second vaporizer to range from about 0% to about 70% of a maximum output of the second vaporizer.

13. The aerosol generating device of claim 1, further comprising a chamber in which the first aerosol and the second aerosol are mixed.

14. The aerosol generating device of claim 13, wherein at least a portion of the chamber is formed as the first vaporizer is coupled to the second vaporizer.

15. The aerosol generating device of claim 13, wherein the first vaporizer and the second vaporizer are integrally formed, and at least a portion of the chamber is formed by the first vaporizer and the second vaporizer that are integrally formed.

* * * * *